US008639169B2

(12) United States Patent
Cao et al.

(10) Patent No.: US 8,639,169 B2
(45) Date of Patent: Jan. 28, 2014

(54) BELT FUSER FOR AN ELECTROPHOTOGRAPHIC PRINTER HAVING TUBULAR HEATING SUPPORT MEMBER

(75) Inventors: Jichang Cao, Lexington, KY (US); Scott Shiaoshin Wu, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 422 days.

(21) Appl. No.: 12/473,967

(22) Filed: May 28, 2009

(65) Prior Publication Data

US 2010/0303524 A1 Dec. 2, 2010

(51) Int. Cl.
*G03G 15/20* (2006.01)

(52) U.S. Cl.
USPC ..... 399/329

(58) Field of Classification Search
USPC ..... 399/329, 328, 69
See application file for complete search history.

(56) References Cited

U.S. PATENT DOCUMENTS

| | | | | |
|---|---|---|---|---|
| 5,602,635 | A | 2/1997 | Domoto et al. | |
| 5,774,763 | A * | 6/1998 | Muramatsu | 399/69 |
| 5,974,294 | A * | 10/1999 | Tange | 399/328 |
| 7,076,198 | B2 * | 7/2006 | Kim et al. | 399/330 |
| 7,235,761 | B1 | 6/2007 | Maul et al. | |
| 7,466,951 | B2 | 12/2008 | Gilmore | |
| 2003/0063931 | A1 * | 4/2003 | Sanpei et al. | 399/328 |
| 2006/0067752 | A1 | 3/2006 | Cao et al. | |
| 2006/0198671 | A1 * | 9/2006 | Kawahata | 399/329 |
| 2008/0175633 | A1 * | 7/2008 | Shinshi | 399/329 |
| 2008/0232871 | A1 * | 9/2008 | Jung et al. | 399/329 |
| 2009/0208264 | A1 | 8/2009 | Fujiwara et al. | |
| 2010/0167065 | A1 | 7/2010 | Cao et al. | |
| 2010/0303524 | A1 | 12/2010 | Cao et al. | |
| 2012/0070207 | A1 | 3/2012 | Cao et al. | |

FOREIGN PATENT DOCUMENTS

| | | | |
|---|---|---|---|
| JP | 52102736 | A * | 8/1977 |
| JP | 06-035354 | | 2/1994 |
| JP | 06035354 | A * | 2/1994 |
| JP | 07-287461 | | 10/1995 |
| JP | 07287461 | A * | 10/1995 |
| JP | 11052768 | A * | 2/1999 |
| JP | 2001125409 | A * | 5/2001 |

OTHER PUBLICATIONS

Office Action for U.S. Appl. No. 12/886,241, Aug. 17, 2012.
Notice of Allowability for USPTO U.S. Appl. No. 12/886,241, Apr. 9, 2013.

* cited by examiner

*Primary Examiner* — Quana M Grainger

(57) ABSTRACT

A fuser and method of use for an electrophotographic imaging device that includes a lamp heater assembly; an endless fusing belt having a flexible tubular configuration and being positioned about the lamp heater assembly and spaced outwardly therefrom; a transparent or translucent pressure tube having an elongated tubular body and a pair of opposite ends, the body being substantially transparent to passage of radiant heat therethrough; a pressure tube support assembly having a frame and a pair of bearings mounted on the frame spaced apart from one another and supporting the pressure tube at the opposite ends of the tubular body thereof such that the tubular body of the pressure tube is positioned around the lamp heater assembly and inside the fusing belt and enables radiant heat generated by the lamp heater to pass through the transparent or translucent pressure tube and heat the fusing belt.

12 Claims, 5 Drawing Sheets

| 35mm QUARTZ TUBE, 40mm SR BELT, AND 35mm BUR HEATING POWER = 1200W | |
|---|---|
| FUSING TEMPERATURE (C) | WARM-UP TIME (SECONDS) |
| 170 | 11.9 |
| 180 | 13.9 |
| 190 | 16.1 |
| 200 | 18.4 |

Fig. 5

| 25mm QUARTZ TUBE, 30mm SR BELT, AND 35mm BUR HEATING POWER = 1200W | |
|---|---|
| FUSING TEMPERATURE (C) | WARM-UP TIME (SECONDS) |
| 170 | 9.75 |
| 180 | 11.35 |
| 190 | 12.95 |
| 200 | 14.6 |

Fig. 6

BELT FUSER FOR AN ELECTROPHOTOGRAPHIC PRINTER HAVING TUBULAR HEATING SUPPORT MEMBER

CROSS REFERENCES TO RELATED APPLICATIONS

None.

BACKGROUND

1. Field of the Invention

The present invention relates generally to electrophotographic imaging device and, more particularly, to fusers of electrophotographic imaging devices.

2. Description of the Related Art

In the electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to the media intended to receive the final permanent image. The toner is fixed to the media by the application of heat and pressure in a fuser. A fuser may include a heated roll and a backup roll forming a fusing nip through which media passes, known as a hot roll fuser. A fuser may also include a fuser belt and an opposing backup member, such as a backup roll, known as a belt fuser.

A hot roll fuser is a high force and pressure fuser that can deliver high print quality, however a hot roll fuser is not an "instant on" fuser having a very short warm-up time due to the huge thermal mass of thick metal core and thick silicone rubber layer coated on the metal core. While a belt fuser with a ceramic heater or induction heater can be an "instant on" fuser, it is usually only used for low speed color laser printers due to lower belt operating temperatures. Since the belt is only heated within a fuser nip region, belt temperature during a print operation is about 60 degrees C. lower than its heater temperature. Therefore, a belt fuser with a ceramic heater has difficulty to provide enough heat for high speed fusing. In addition, the fusing quality of a belt fuser with a ceramic heater is not as good as that of a hot roll fuser.

In order to achieve a very short warm-up time, an "instant on" fuser, like a belt fuser with a ceramic or induction heater, uses an endless fusing belt that can be heated very fast due to its small thermal mass. Since the fusing belt is very thin and flexible, force cannot be directly applied to both ends of the belt to form a required fuser nip. To form a fuser nip, a stationary pressure member, a heater and a heater housing with a steel bracket for a ceramic belt fuser is put inside the belt tube. Forces are applied to both ends of the steel bracket and the pressure member forces the fusing belt to firmly contact against a backup roll to form a fuser nip. The pressure member is fixed and does not turn. Since the pressure member is not turning with the belt, friction forces between the contact surfaces of the belt and the pressure member are very high and can wear the belt and ceramic heater, which reduces fuser lifetime. Even with lubrication between the contact surface of the belt and the stationary pressure member, belt stall still occurs as the lubrication often fails which causes serious wear on heater surface or belt. In order to reduce the friction force, the force used for forming a fusing nip has to be much lower than the force applied to a hot roll fuser. The lower force results in lower nip pressure and the lower nip pressure can cause many print quality problems, such as poor fuse grade, mottling, poor uniformity across a page, and transparency defects.

Thus, there is still a need for a fuser with fast warm up time and high nip pressure in order to deliver high print quality.

SUMMARY OF THE INVENTION

The present invention meets this need by providing a fuser that combines the advantages of a belt fuser with a ceramic heater and a hot roll fuser, and overcomes the disadvantages of low pressure or slow warm-up time. The fuser provides higher fusing quality than that of a belt fuser with a ceramic heater due to higher force/higher nip pressure and longer fuser lifetime due to a lower friction force.

Accordingly, in an aspect of the present invention, a fuser for an electrophotographic imaging device includes a lamp heater assembly; an endless fusing belt having a flexible tubular configuration of predetermined diameter and being positioned about the lamp heater assembly and spaced outwardly therefrom; a transparent or translucent pressure tube having an elongated tubular body of predetermined diameter and a pair of opposite ends, the body being substantially transparent to passage of radiant heat there through; a pressure tube support assembly having a frame and a pair of bearings and bushings mounted on the frame spaced apart from one another and supporting the pressure tube at the opposite ends of the tubular body thereof such that the tubular body of the pressure tube is positioned around the lamp heater assembly and inside the fusing belt and enables radiant heat generated by the lamp heater to pass through the transparent or translucent pressure tube and heat the fusing belt. The pressure tube support assembly is adapted to apply a force via the bushings to the pressure tube such that the pressure tube applies pressure contact to the fusing belt along a length-wise segment of the fusing belt. A backup roll is positioned in opposition to the length-wise segment of the fusing belt and to the pressure tube contained within the fusing belt in counter relation to the pressure applied by the pressure tube on the length-wise segment of the fusing belt such that the fusing belt and the backup roll form a fuser nip.

In another aspect of the present invention, a method of operating a fuser of an electrographic imaging device includes establishing a fusing nip between an endless fusing belt and a backup roller by applying pressure against a length-wise segment of the endless fusing belt facing the backup roller, the pressure being applied by a pressure tube, the pressure tube housing a lamp heater inside the pressure tube; carrying a print medium having toner particles thereon through the fusing nip between the fusing belt and the backup roller; and fusing toner particles on the print medium to the print medium by transferring heat to the toner particles from the endless fusing belt that is heated by radiation from the lamp heater through the pressure tube.

BRIEF DESCRIPTION OF THE DRAWINGS

Figure 1:
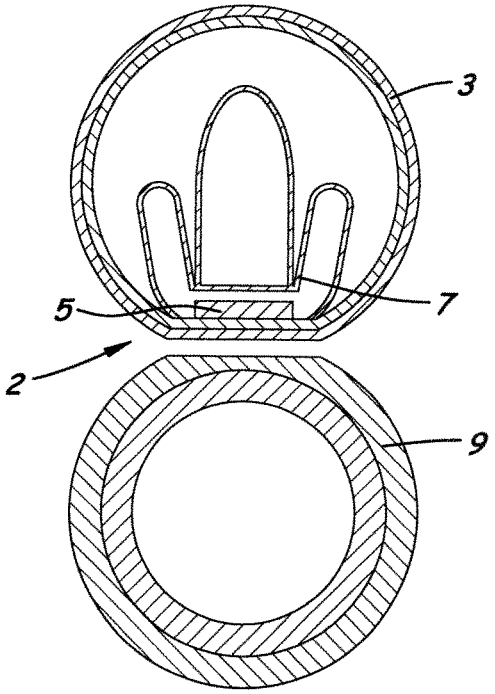

Having thus described the invention in general terms, reference will now be made to the accompanying drawings, which are not necessarily drawn to scale, and wherein:

FIG. 1 is a cross sectional view of a prior art belt fuser with a ceramic heater.

Figure 2:
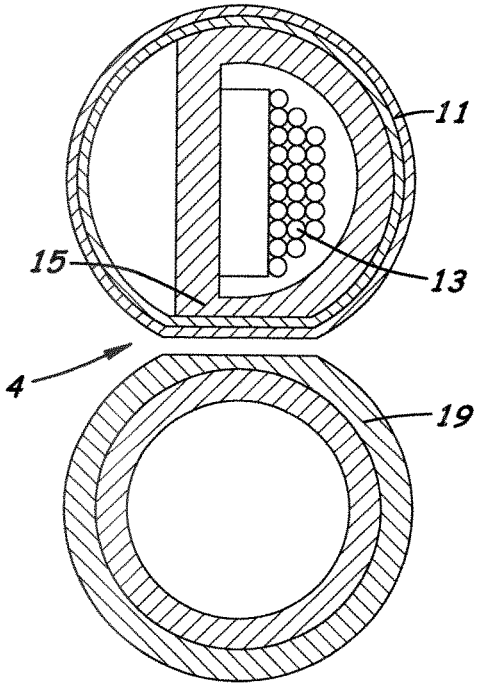

FIG. 2 is a cross sectional view of a prior art belt fuser with an inductive heater.

Figure 3:
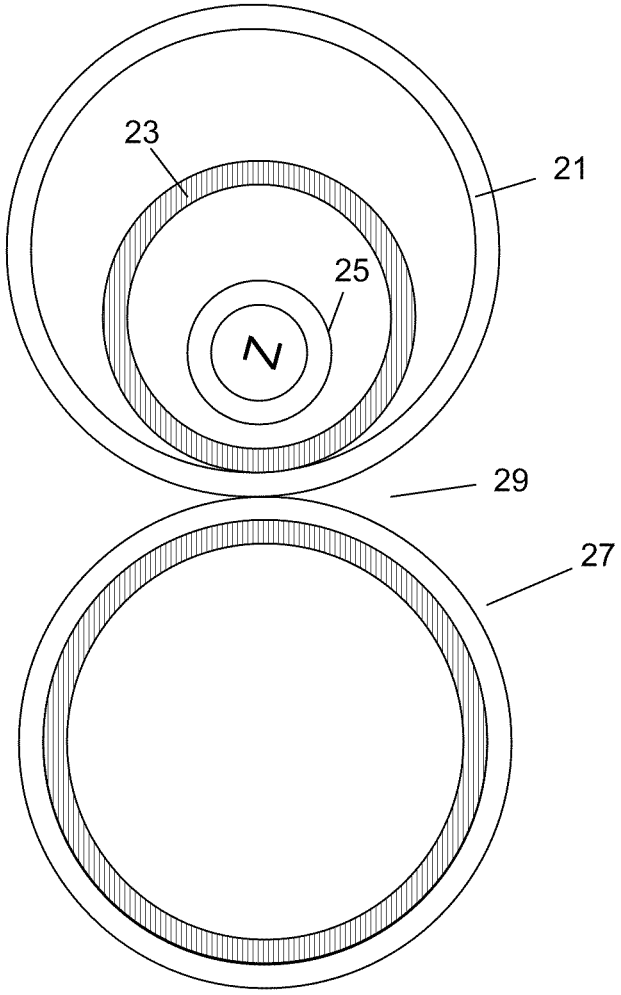

FIG. 3 is a cross sectional view of the pressure tube belt fuser according to an exemplary embodiment of the present invention.

Figure 4A:
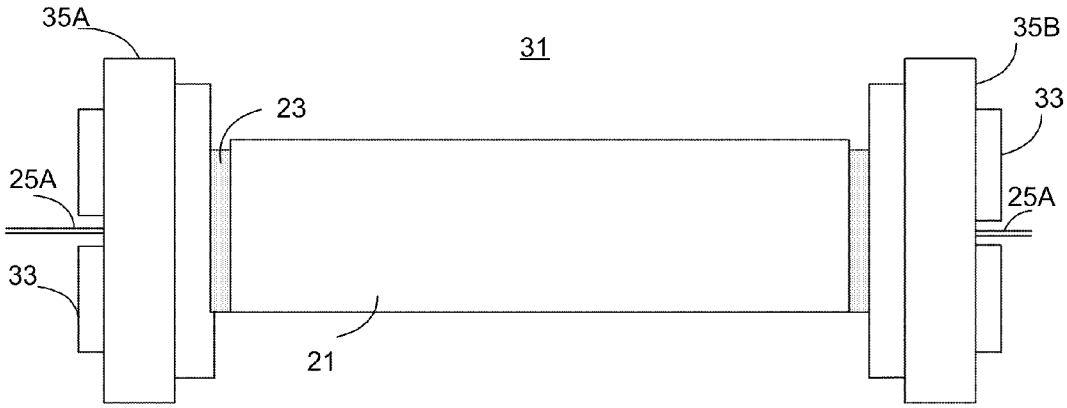

FIG. 4A is a side view of the pressure tube belt fuser according to an exemplary embodiment of the present invention.

Figure 4B:
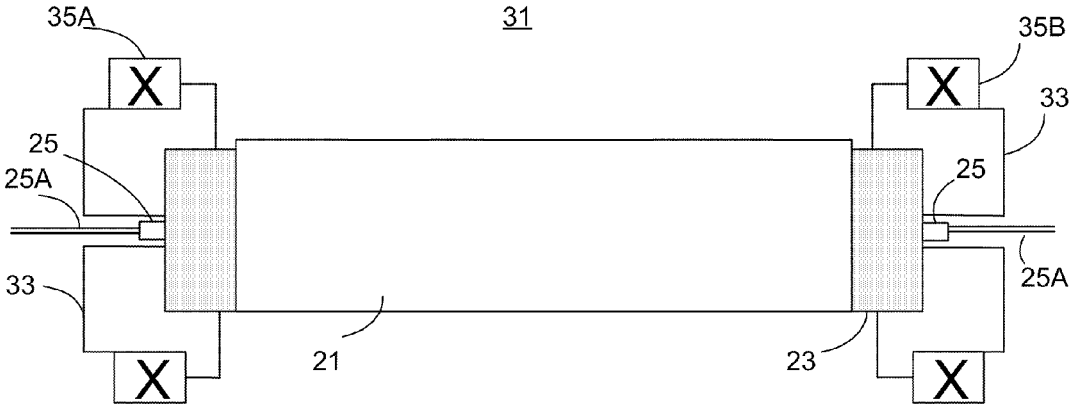

FIG. 4B is a cross sectional side view of the pressure tube belt fuser of FIG. 4A taken along the longitudinal axis thereof.

FIG. 5 is a table showing fuser warm-up time of a pressure tube fuser using a 40 mm steel-rubber fusing belt of an exemplary embodiment of the present invention.

FIG. 6 is a table showing fuser warm-up time of a pressure tube fuser using a 30 mm steel-rubber fusing belt of another exemplary embodiment of the present invention.

Figure 7:
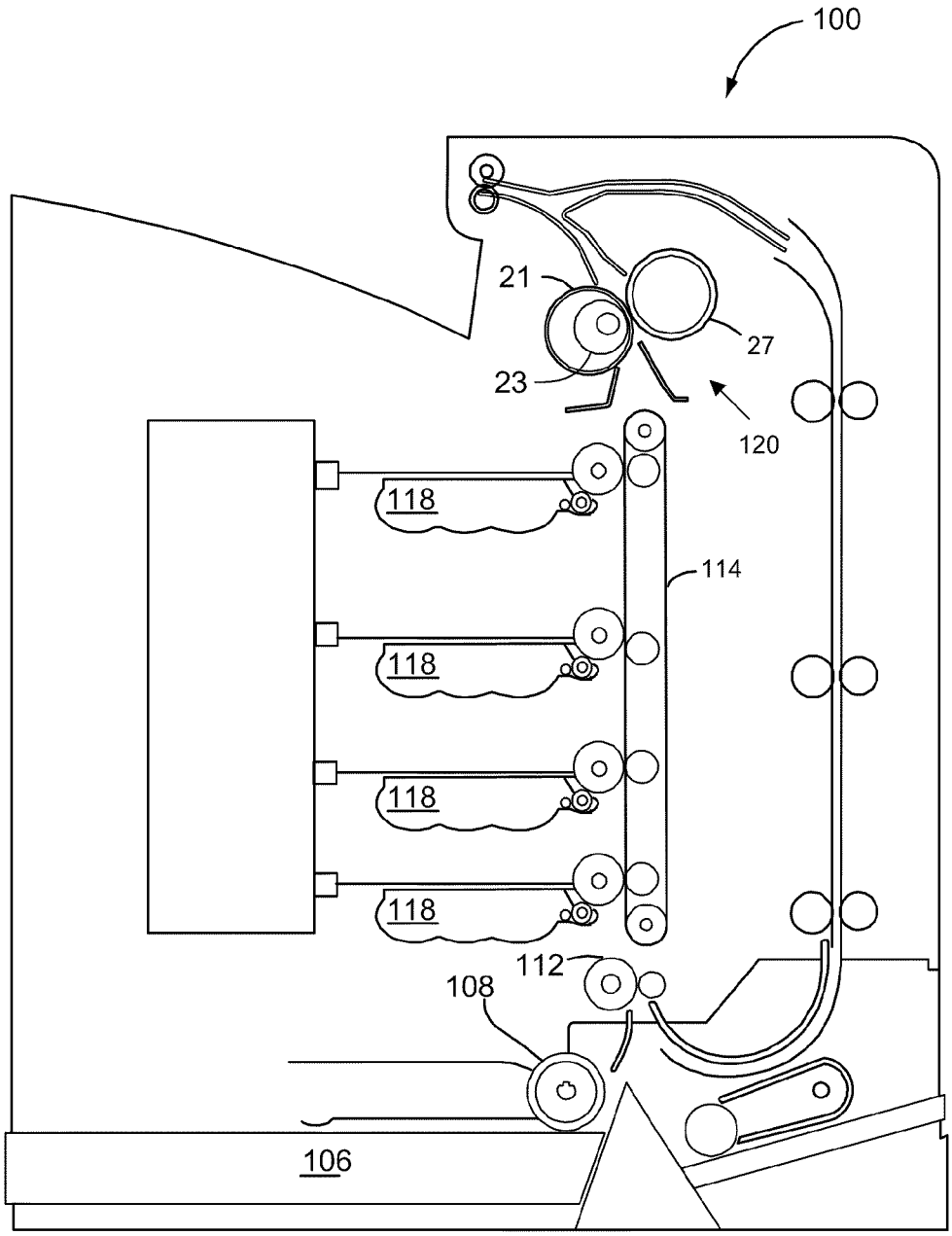

FIG. 7 is a side elevational view of an imaging apparatus including the pressure tube belt fuser according to exemplary embodiments of the present invention.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIG. 1, there is illustrated a side view of a prior art belt fuser with a ceramic heater. In order to form a fuser nip 2, a stationary pressure member 7, a ceramic heater 5 and a heater housing with a steel bracket (not shown) are positioned inside an endless fusing belt 3. The stationary pressure member 7 forces the endless fusing belt 3 to contact a pressure roll 9 to form a fuser nip 2. Stationary pressure member 7 does not turn with the endless fusing belt 3, which results in a friction force between the contact surfaces of the endless fusing belt 3 and the ceramic heater. This friction force can result in belt wear and can reduce belt lifetime.

Referring now to FIG. 2, there is illustrated a side view of a prior art belt fuser with an inductive heater. A stationary pressure member 15, an inductive heater 13 and a heater housing (not shown) are positioned inside an endless fusing belt 11. The stationary pressure member 15 forces the endless fusing belt 11 to contact a pressure roll 19 to form a fuser nip 4. Once again, stationary pressure member 15 does not turn with the endless fusing belt 11, which results in a friction force between the contact surfaces of the endless fusing belt 11 and the stationary pressure member 15. This friction force can result in belt wear and can reduce belt lifetime.

Referring now to FIG. 3, there is illustrated a side view of the pressure-tube belt fuser of an exemplary embodiment of the present invention. A lamp heater 25 serves as a heating source and is positioned inside a pressure tube 23, which has an elongated tubular body of predetermined diameter and a pair of opposite ends, with the tubular body being substantially transparent or translucent to allow the passage of radiant heat from the lamp heater 25. An endless fusing belt 21 having a flexible tubular configuration of predetermined diameter is positioned about the pressure tube 23 and spaced outwardly from the pressure tube 23. The pressure tube 23 is positioned around the lamp heater 25 and inside the fusing belt 21 and enables transmission of radiant heat from the lamp heater 25 to the fusing belt 21 to heat the fusing belt 21. The pressure tube 23 is seated upon a pressure-tube support assembly (not shown in FIG. 3). A pressure or backup roll 27 is positioned in opposition to the length-wise segment of the fusing belt 21 and to the pressure tube 23 contained within the fusing belt 21. Pressure is applied by the pressure tube 23 on the length-wise segment of the fusing belt 21 such that the fusing belt 21 and the pressure roll 27 form a fuser nip 29.

The fusing belt 21 may be, for example, a steel belt, or polyimide belt, or steel belt coated with silicone rubber on its top surface, or polyimide belt coated with silicone rubber on its top surface. The outside surface of the belt may have a toner release layer such as a layer of fluoropolymer coating or sleeve.

The pressure tube 23 may have greater than 70%, and particularly at least 90%, transparency to the emission spectrum of the lamp heater 25 so that most radiant heat from lamp heater 25 can pass through the pressure tube 23 to heat the fusing belt 21 directly. The pressure tube 23 is used as a pressure member and can be stationary or rotational. The pressure tube 23 may be constructed from quartz, such as transparent or translucent quartz, or glass, and may be substantially hollow. The thickness of pressure tube 23 may be between about 1 mm and about 5 mm in order to maintain a relatively low thermal mass. The diameter of the pressure tube 23 may be between about 10 mm and about 75 mm, and in particular may be between about 25 mm and about 35 mm. The pressure tube 23 diameter may be smaller than the diameter of the fusing belt 21 in order to assure fast warm up of the belt. For example, the diameter of pressure tube 23 may be between about 0.2 mm and about 50 mm less than the diameter of fusing belt 21, and in particular may be between about 2 mm and about 15 mm less than the diameter of fusing belt 21. In another embodiment of the present invention, the diameter of pressure tube 23 may be between about 2 mm and about 5 mm less than the diameter of fusing belt 21. A difference in diameter between pressure tube 23 and fusing belt 21 allows for pressure tube 23 and fusing belt 21 to physically contact each other only in the region of fuser nip 29, as shown in FIG. 3. Because during a fusing operation, especially in the warm-up period, the temperature of the fusing belt 21 is greater than the temperature of the pressure tube 23, physical contact between pressure tube 23 and fusing belt 21 along portions outside of fuser nip 29 is seen to disadvantageously cause heat transfer from fusing belt 21 to pressure tube 23, thereby reducing the fusing temperature of fusing belt 21 and making the fusing operation less effective.

The diameters of the fusing belt 21 and the pressure tube 23 are selected in order to make the contact area between the fusing belt 21 and the pressure tube 23 as small as possible in order to reduce the heat transfer from the fusing belt 21 to the pressure tube 23 so that the belt can be warmed up relatively fast, as described above. In addition, the diameters are sized relative to each other so that only a relatively small space exists where there is no contact, in order to reduce the possibility of belt skew. The diameter of the pressure tube 23 can be determined first based on fuser nip size requirements or a residence time requirement. Then based on the determined pressure tube size, the diameter of the fusing belt 21 can be selected accordingly, while taking into consideration that too large of a diameter undesirably increases the thermal mass of the belt which results in an increased warm-up time; and too small of a diameter undesirably increases the contact area of the fusing belt 21 and the pressure tube 23 which also increases the warm-up time. Since the pressure tube 23 is sufficiently transparent to allow more than 70% (and in some cases at least 90%) of the IR energy generated by the lamp heater 25 to pass through the pressure tube 23 to heat the fusing belt 21 directly and the heat transferred from the belt to the pressure tube is minimized, most of the heat generated by the lamp heater 25 is used to directly heat the fusing belt 21 during fuser warm-up. As a result, the warm-up time for raising the belt temperature from room temperature to the target fusing temperature can be significantly reduced. For a polyimide belt with 30 mm in diameter, the warm-up time of the belt can be reduced to be less than about 8 seconds.

It is understood that pressure roll 27 may include more than one layer. For instance, pressure roll 27 may include an inner metal core and an outer layer, such as a silicone rubber layer, as depicted in FIG. 3.

Referring now to FIG. 4A, there is illustrated a side view of the pressure-tube support assembly of the present invention. A pressure tube support assembly 31 has a frame, a pair of bushings 33 and a pair of bearings 35A and 35B mounted on the bushings 33. Bushings 33 are spaced apart from one another and support the pressure tube 23 at opposite ends of the tubular body such that the tubular body of the pressure tube 23 is positioned around the lamp heater 25 (not shown in FIG. 4A) and inside the fusing belt 21 and enables transmission of radiant heat of the lamp heater to fusing belt 21 in order to heat the fusing belt 21. Each bushing 33 may receive an end of pressure tube 23 in relatively tight engagement therewith so that the rotational movement of pressure tube 23 rotates bushings 33.

The pressure tube support assembly 31 is adapted to apply a force via the bushings 33 and bearings 35A and 35B to the pressure tube 23 such that the pressure tube 23 applies pressure contact to the fusing belt 21 along a length-wise segment of the fusing belt 21. Since the pressure tube 23 and bushings 33 are seated on the ball bearings 35A and 35B at both ends of pressure tube 23, the friction torque is significantly lower than that of the prior art belt fusers shown in FIGS. 1 and 2 that have stationary pressure members. Therefore, the pressure tube 23 can take a higher load to generate enough nip pressure for printing quality without causing high torque and belt stall issues.

FIG. 4B shows the pressure tube support assembly 31 in cross section taken along the longitudinal axis of pressure tube 23. As can be seen, one or more bushings 33 includes an aperture through which one or more wires 25A of lamp heater 25 may extend for controlling and/or activating lamp heater 25.

Referring now to FIG. 5, there is illustrated a table showing fuser warm up time according to the present invention in FIGS. 3 and 4 using a lamp heater that delivers 1200 W heating power, a quartz pressure tube 35 mm in diameter, a steel-rubber belt 40 mm in diameter, and a pressure roll 35 mm in diameter. Using this configuration, the fuser belt temperature can be warmed up from room temperature to 180 degrees C. within 14 seconds since above 90% of radiant heat produced by the lamp heater can pass through the quartz pressure tube to heat the fusing belt directly. In an exemplary embodiment, the lamp heater of the present invention is able to deliver 1200 W of heating power.

Referring now to FIG. 6, there is illustrated a table showing fuser warm up time according to the present invention in FIGS. 3 and 4 using a lamp heater that delivers 1200 W heating power, a quartz pressure tube of 25 mm in diameter, a steel-rubber belt 30 mm in diameter, and a pressure roll 35 mm in diameter. Using this configuration, the fuser belt temperature can be warmed from room temperature to 180 degrees C. within 11.4 seconds.

The fusing belt temperature can be warmed up from room temperature to its fusing temperature in a very short time as fusing belt 21 has a small thermal mass. The fusing belt 21 can achieve fast warm-up time and can relatively easily be kept above 200 degrees C. The belt fusers shown in FIGS. 1 and 2 cannot be maintained at or above 180 degrees C. as they must be kept below the temperature limits of materials such as grease. According to the exemplary embodiments shown in FIGS. 3 and 4, the pressure tube 23 can be driven to spin by the pressure roll 27 through the fusing belt 21 at the fuser nip 29 by friction contact, or it can be directly driven to spin by a motor (not shown). The pressure roll 27, pressure tube 23 and fusing belt 21 are each rotatable, therefore lubrication between the contact surfaces is not needed. Since the pressure tube 23 can undertake a high load to generate enough nip pressure for printing quality without causing high torque and belt stall issues and since the fusing belt 21 can achieve relatively fast warm up and be maintained above 200 degrees C., the fuser of exemplary embodiments of the present invention is able to fuse from about 40 ppm to about 70 ppm in color with a fusing quality higher than that of prior art belt fusers.

As mentioned, a belt fuser as described above may be utilized in electrophotographic imaging devices, such as imaging device 100 shown in FIG. 7. Imaging device 100 may include a paper supply tray 106 containing a stack of print media, such as paper, transparencies or the like. A print medium transport assembly (not numbered) includes a plurality of rolls and/or transport belts for transporting individual media sheets through imaging device 100. For example, in the illustrated embodiment, the print medium transport assembly includes a pick roll 108 and a paper transport belt 114. Pick roll 108 picks an individual media sheet from within paper supply tray 106 and transports the media sheet to media transport belt 114 via a nip defined in part by roll 112. Media transport belt 114 transports the picked media sheet past a plurality of color imaging stations 118 which apply toner particles of a given color to the media sheet at selected pixel locations. In the embodiment shown, color imaging stations 118 may include black, yellow, magenta and cyan stations.

Media transport belt 114 further transports the media sheet to fuser 120 where the toner particles are fused to the media sheet through the application of heat, as described hereinabove. Fuser 120 may include fusing belt 21, pressure tube 23, lamp heater 25 and pressure roll 27 as described above. In the embodiment shown, pressure roll 27 is driven; however, pressure tube 23 may be driven in an alternative embodiment.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A fuser for an electrophotographic imaging device, said fuser comprising:

a lamp heater assembly;

a fusing belt being endless having a flexible tubular configuration and being positioned about said lamp heater assembly and spaced outwardly therefrom;

a pressure tube having a tubular body and a pair of opposite ends, said tubular body being elongated and substantially transparent to the passage of radiant heat therethrough;

a pressure tube support assembly having a frame supporting said pressure tube at said opposite ends of said tubular body thereof such that said tubular body of said pressure tube is positioned around said lamp heater assembly and inside said fusing belt and enables transmission of heat radiation from said lamp heater assembly to heat said fusing belt, said pressure tube support assembly adapted to apply a force such that said pressure tube applies pressure contact to said fusing belt along a length-wise segment of said fusing belt; and a backup roll positioned in opposition to said length-wise segment of said fusing belt and to said pressure tube contained within said fusing belt in counter relation to the pressure applied by said pressure tube on said length-wise segment of said fusing belt such that said fusing belt and said backup roll form a fuser nip, wherein said pressure tube is supported in a stationary manner by said pressure tube support assembly.

2. The fuser of claim 1 wherein said tubular body of said pressure tube has a level of transparency to IR emission spectrum that is greater than about seventy percent.

3. The fuser of claim 1 wherein said tubular body of said pressure tube is one of a quartz tube and a glass tube.

4. The fuser of claim 1 wherein said pressure tube is supported by said pressure tube support assembly for rotational movement relative to said lamp heater assembly.

5. The fuser of claim 1 wherein a diameter of said fusing belt is greater than a diameter of said pressure tube such that physical contact between said fusing belt and said pressure tube only occurs at said length-wise segment of said fusing belt at said nip region.

6. The fuser of claim 1, wherein said pressure tube has a diameter between about 25 mm and about 35 mm.

7. The fuser of claim 1 wherein said fusing belt has a diameter of about 0.2 mm to about 50 mm greater than the diameter of said pressure tube.

8. A fuser for an electrophotographic imaging device, comprising:

a lamp heater assembly;

a fusing belt being endless having a flexible tubular configuration and being positioned about said lamp heater assembly and spaced outwardly therefrom;

a pressure tube having a tubular body and a pair of opposite ends, said tubular body being elongated and substantially transparent to the passage of radiant heat therethrough;

a pressure tube support assembly having a frame supporting said pressure tube at said opposite ends of said tubular body thereof such that said tubular body of said pressure tube is positioned around said lamp heater assembly and inside said fusing belt and enables transmission of heat radiation from said lamp heater assembly to heat said fusing belt, said pressure tube support assembly adapted to apply a force such that said pressure tube applies pressure contact to said fusing belt along a length-wise segment of said fusing belt; and a backup roll positioned in opposition to said length-wise segment of said fusing belt and to said pressure tube contained within said fusing belt in counter relation to the pressure applied by said pressure tube on said length-wise segment of said fusing belt such that said fusing belt and said backup roll form a fuser nip, wherein said pressure tube is supported by said pressure tube support assembly for rotational movement relative to said lamp heater assembly, and wherein said pressure tube is driven to rotate by said backup roll through said fusing belt via fuser nip friction.

9. The fuser of claim 1 wherein said fusing belt has a diameter of about 2 mm to about 5 mm greater than the diameter of said pressure tube.

10. A method of operating a fuser of an electrographic imaging device comprising:

establishing a fusing nip between an endless fusing belt and a backup roller by applying pressure against a length-wise segment of the endless fusing belt facing the backup roller;

carrying a print medium having toner particles thereon through the fusing nip between the endless fusing belt and the backup roller; and fusing toner particles on the print medium to the print medium by transferring heat to the toner particles from the endless fusing belt, comprising radiating energy from an area within the endless fusing belt to provide heat thereto, wherein said radiating comprises radiating the energy from a lamp to the endless fusing belt via a substantially transparent or translucent member around which the endless fusing belt is disposed, said applied pressure being created between the backup roller and the substantially transparent or translucent member, and wherein said fusing comprises rotating the backup roller, said backup roller rotating causing the substantially transparent or translucent member to rotate.

11. The method of claim 10 wherein said fusing comprises rotating the substantially transparent or translucent member.

12. The fuser of claim 1, wherein said pressure tube has a diameter between about 10 mm and about 75 mm.

* * * * *